United States Patent [19]

Moody et al.

[11] 3,999,821

[45] Dec. 28, 1976

[54] SUSPENSION AND DISPLAY DEVICE AND METHOD FOR ARTICLES

[75] Inventors: Charles M. Moody, Brecksville, Ohio; Fredrick L. Priebe, Homewood, Ill.

[73] Assignee: Swift and Company Limited, Chicago, Ill.

[22] Filed: Apr. 1, 1975

[21] Appl. No.: 564,041

[52] U.S. Cl. ..... 312/236; 62/62; 62/246; 211/59.1; 211/119; 312/116; 312/129

[51] Int. Cl.[2] ..... A47F 3/04

[58] Field of Search ..... 211/57, 59, 113, 119, 211/118; 312/116, 118, 128, 129, 236; 248/303; 62/246, 407, 458, 62, 249

[56] References Cited

UNITED STATES PATENTS

| | | | |
|---|---|---|---|
| 2,488,582 | 11/1949 | Cinamon | 211/119 |
| 3,186,185 | 6/1965 | Bently et al. | 312/116 |
| 3,256,709 | 6/1966 | Stepleton | 312/116 |
| 3,442,396 | 5/1969 | Cass | 211/59 |
| 3,501,925 | 3/1970 | Brennan et al. | 62/458 |
| 3,827,254 | 8/1974 | MacMaster et al. | 62/458 |

FOREIGN PATENTS OR APPLICATIONS

| | | | |
|---|---|---|---|
| 217,061 | 9/1961 | Austria | 62/246 |
| 1,191,245 | 10/1959 | France | 211/119 |

*Primary Examiner*—Roy D. Frazier
*Assistant Examiner*—William E. Lyddane
*Attorney, Agent, or Firm*—Edward T. McCabe; Charles E. Bouton; Raymond M. Mehler

[57] ABSTRACT

An improved device and method for displaying and suspending packaged articles is provided. The device includes at least one arm from which articles may be hung, preferably within a display case. The method includes contacting such suspended articles with a conditioned environment. In one embodiment, particularly well suited for use within a conditioned-environment display case, pairs of arms are staggered and lie along planes perpendicular to each other.

11 Claims, 5 Drawing Figures

SUSPENSION AND DISPLAY DEVICE AND METHOD FOR ARTICLES

This invention relates generally to a device for suspending articles, preferably within a display case, and a method for conditioning such articles.

Always of concern in the retailing of articles, particularly packaged articles, is the location within a particular store of areas suitable for effectively storing such articles which will also serve to display them so as to direct the attention of consumers thereto. This concern is particularly acute when the allocation of the limited space within display cases is involved. There is only a certain amount of shelf space within such display cases, and often a supplier finds he is detained or precluded from entering a product within a certain market because there is no shelf space available for that product. Such shelf space is usually at a unusually high premium in conditioning display cases where one must be concerned not only with the utilization of store floor area, but also with expenditures of energy needed to condition such cases.

It would be to the advantage of retailers and of most suppliers to provide for additional shelf and display space without having to increase the amount of floor space available. It would be particularly advantageous to provide such additional shelf or display space within display cases to thereby utilize more efficiently the raw materials out of which the cases are constructed. When the cases regulate the temperature or other conditions of their contents, energy savings would also be realized in that a greater amount of product would be maintained within a specified environment than would be otherwise possible in conditioned cases where some space is not being effectively utilized to store and display products.

It is accordingly an object of this invention to provide a structure and method which make possible the utilization of previously unused product storage and display space.

It is also an object of this invention to provide an improved apparatus and method whereby products may be kept properly conditioned and suspended for prominent display within heretofore unused portions of display cases.

The present invention is an improved method and apparatus for displaying articles, products and the like by suspending a plurality of such products in otherwise unused or underused display space. The invention is particularly adapted to displaying such product in controlled-condition spaces, that is where the nature and degree of lighting may be regulated and where the surrounding gaseous environment may be adjusted as to movement, temperature, and humidity, or any combination of those and similar conditions, and especially where the display space is refrigerated by streams of air. Basically the present invention involves the positioning within a conditioned space of one or more hanger members having elongated bodies with attaching means at each end thereof and one or more arms extending outwardly from one end thereof, and hanging articles on said arm so as to be exposed to the conditions within the space.

Additional objects, if not set forth specifically herein, will be readily apparent to those skilled in the art from the detailed description of the invention which follows and from the drawings in which.

The method of this invention accomplishes the storage and display of articles in an environment subjected to controlled conditions, such as those that are refrigerated, heated, dried, humidified, varied as to lighting type or intensity, or combinations of these. It is particularly well-suited for applications where the environmental conditions are controlled by a stream of cooled air.

Often, articles are placed within a case for maintaining a controlled environment and has an open front for easy access to the articles. Heretofore, such articles were located only either within a cabinet generally below the open front or on rear shelves opening toward such open front. The present improved method accomplishes a utilization of the otherwise open and unused or underused space within these cases, such space being located between the open front and the rear shelves. This space is at an especially advantageous location in that it is at approximate eye level and within easy reach.

Essentially, the present method includes suspending a plurality of articles within this space and subjecting the articles to the controlled environment. In a preferred embodiment, the controlled environment is provided by a downwardly directed stream of cooled air. The stream passes along an uppermost row of articles which lie along generally vertical planes substantially parallel to each other and thereafter passes along a lower row of substantially parallel articles which latter, lower articles lie along generally vertical planes that are substantially perpendicular to said planes of the former, uppermost articles. If desired, a third, fourth, or further row of articles can be provided, continuing with this general pattern of article orientation. Especially efficient direction of a cooled air stream may obtain when the planes of the uppermost row of articles are generally parallel to the open front when the space is located in a display case having an open front, since such uppermost articles would assist in preventing the stream from escaping through the open front.

Figure 1:
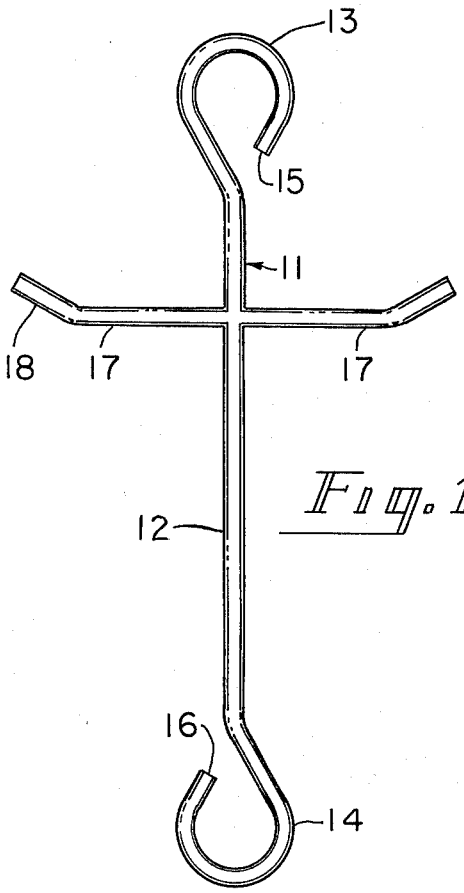
FIG. 1 is an elevation view of a preferred hanger member of the invention.

FIG. 1 illustrates a preferred hanger member, generally indicated by reference numeral 11. Hanger member 11 includes elongate body member 12, terminating in its upper end with an attaching means such as eye-and-hook member 13 and in its lower end with a similar attaching means such as eye-and-hook member 14. Members 13 and 14 can function as either or both an eye or a hook. When used as a hook, structures capable of passing through an opening defined as the spacing between an end of body member 12 and the corresponding end 15, 16 of each member 13, 14 can be attached thereto. When members 13, 14 also function as an eye, hook-like structures may be passed therethrough.

Protruding outwardly and preferably also perpendicularly from said body member 12 is at least one arm 17 oriented so as to lie substantially horizontally when said hanger member 11 is vertically suspended. Preferably, arm 17 has an upwardly directed stop 18 positioned at the outer free end thereof. In the preferred embodiment, member 11 has a pair of arms 17 extending in opposite directions from a location near the upper end of the body member 12.

Figure 2:
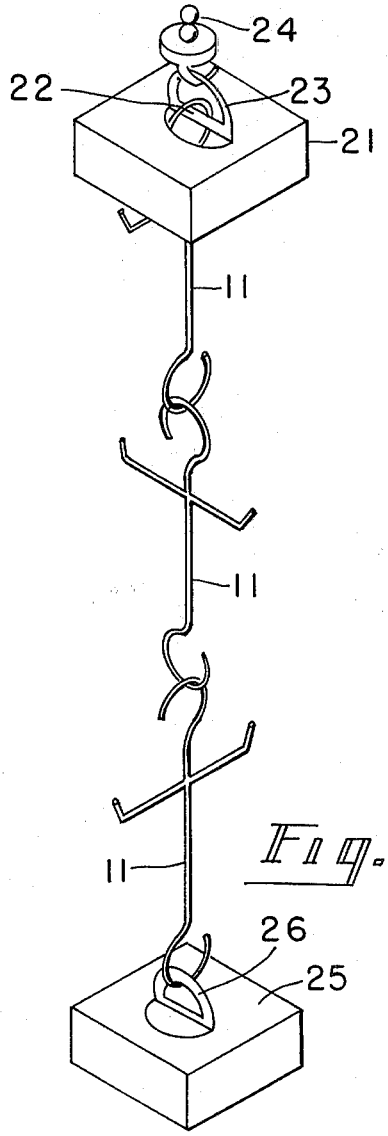
FIG. 2 is a perspective view of a plurality of elements shown in FIG. 1, joined together to form an embodiment.

An embodiment using a plurality of such hanger members 11 is shown in FIG. 2. Here, three hanger members 11 are shown as suspended one from the other, whereby the lower member 14 of a first (top) hanger member 11 engages the upper member 13 of a second hanger member 11 to thus suspend the second member. Likewise, the lower member 14 of said second member engages the upper member 13 of a third (bottom) hanger member 11 to thus suspend the third member. It will be apparent to those skilled in the art that less or more than three hanger members 11 can be utilized in any specific application of this invention. The arrangement of three hanger members 11 shown herein is presented to illustrate a mode that is particularly well suited for use within a retail store display case.

Figure 3:
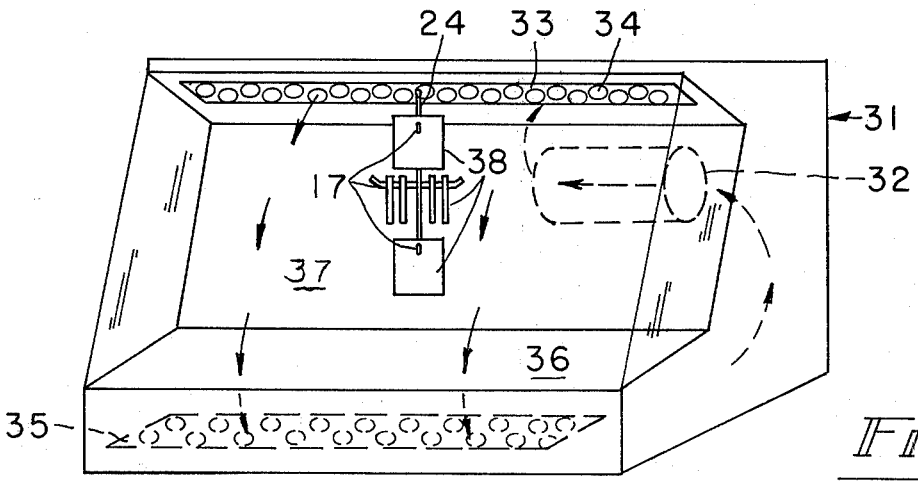
FIG. 3 is a perspective view showing a display installation including the present invention.

First hanger member 11 is itself suspended by its upper member 13. The embodiment of FIG. 2 includes a top cap 21. Such cap 21 can be used to convey an advertising message or the like and can include a bar 22 from which first hanger member 11 is suspended along with an eye 23 for suspending cap 21 from a suspension means 24 which may be a chain (FIG. 2) or a rigid rod (FIG. 3). A chain suspension means permits easy access to articles hung toward the rear of the hanger member 11 which is thus able to rotate or swivel. Alternatively, both cap 21 and first hanger member 11 can be suspended directly from means 24. This embodiment also includes a bottom block 25, preferably of the same general configuration as top cap 21. Block 25 includes an eye 26 by which it is suspended from the lower member 14 of the third hanger member 11. Both top cap 21 and bottom block 25 may be varied from the configuration shown in FIG. 2 to take on any variety of structural features. Block 25 can be used to stabilize the device, especially when articles are hung thereon in an unbalanced fashion, or to convey an advertising message or the like.

In the embodiment shown in FIG. 3, a plurality of hangers 11 are suspended one from the other and without members such as cap 21 and block 25. The device is shown in cooperation with a display case generally indicated by numeral 31. The particular case 31 depicted is an open refrigerated case of the type utilized to store and to display meat and dairy products. The case 31 shown in FIG. 3 includes a refrigeration means 32 for supplying streams of cooled air from an outlet within the top, inside wall of the case 31. Such outlet can be a grillwork 33 having a plurality of slots 34. The grillwork 33 directs the cooled air streams downwardly across an open case front. While some of the cooled air escapes from the case 31 through its open front, much of the cooled air contacts articles stored within the case, especially articles hung on hangers 11, and thereby maintains them at a relatively low temperature. Most of the descending cooled air streams enter an intake, such as vent 35 for recirculation through refrigerator means 32 and grillwork 33.

Heretofore, the articles that have been kept refrigerated by means of cooled air circulation such as that just described have been located on shelves or racks (not shown) in the lower bin 36 or along the inside rear wall 37 of case 31. In accordance with the present invention, articles can be kept at an acceptably low temperature by their being hung from an arm 17 of a hanger member 11 which is itself suspended within the forward portion of the case 31 from a location in the general area of grillwork 33. This forward portion represents display space that is added by the present invention. This space is roughly at eye level and within easy reach.

In the embodiment of FIG. 3, three hanger members 11 are suspended from each other by means of respective eye-and-hook members 13, 14, with the top hanger member being suspended from grillwork 33. Articles 38 requiring refrigeration to maintain their freshness and stability are hung over arms 17. As can be seen from FIG. 3 in this embodiment, no cap 21 or bottom block 25 is provided, and the hanger members 11 are arranged relative to each other such that all of the articles 38 that are suspended from one pair of arms 17 of one hanger member 11 lie along planes that are perpendicular to planes along which lie articles 38 hung on a pair of arms 17 of the other hanger member(s) immediately above and/or below said one hanger member 11. This arrangement assists in having the colled air stream that flows downwardly from grillwork 33 to freely flow down through and about the suspended apparatus and to thereby promote the contact of the cooled air with all of the articles 38. It is also within the scope of this invention to promote such contact while incorporating either or both of a cap 21 or a bottom block 25, which is suitably modified by having louvers, orifices, or the like on the tops thereof to permit the air stream to flow therethrough.

The embodiment depicted in FIG. 3 also may enhance an even distribution of cooled air or an otherwise conditioned environment to each of the articles 38, especially, but not limited to, when suspension means 24 is a rigid rod and the top row of articles are generally parallel to the open front. More particularly, articles 38 hung on members 11 are effectively exposed to the conditions within the display space added by this invention. Such conditions may be provided by a stream of air or other gas which is either heated, cooled, dried, humidified, or the like. They may also be provided to control the nature or degree of lighting within this added display space.

Figure 4:
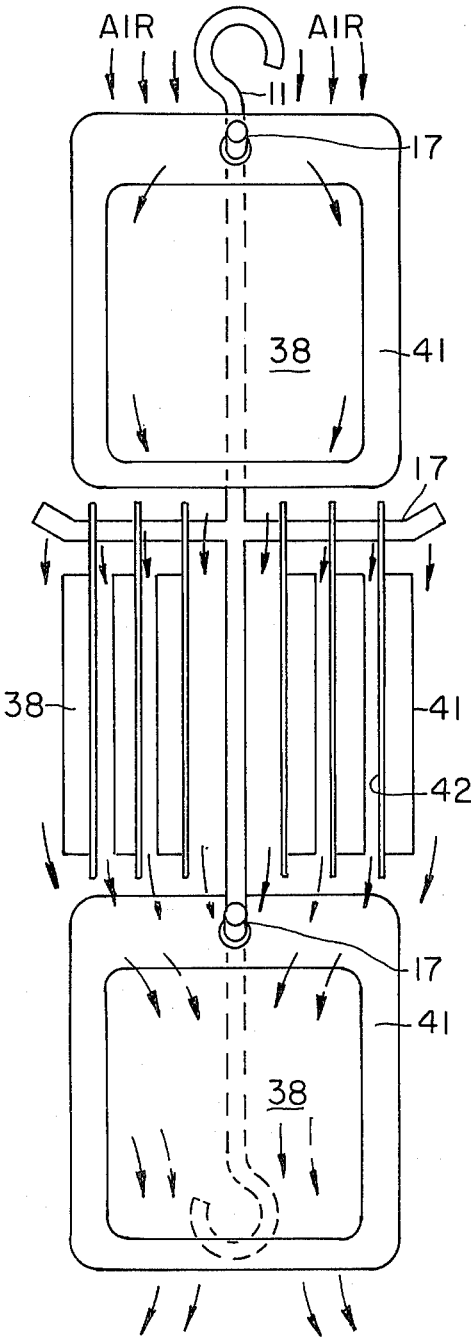
FIG. 4 is a front elevation view of an embodiment of the invention loaded with articles on display.
Figure 5:
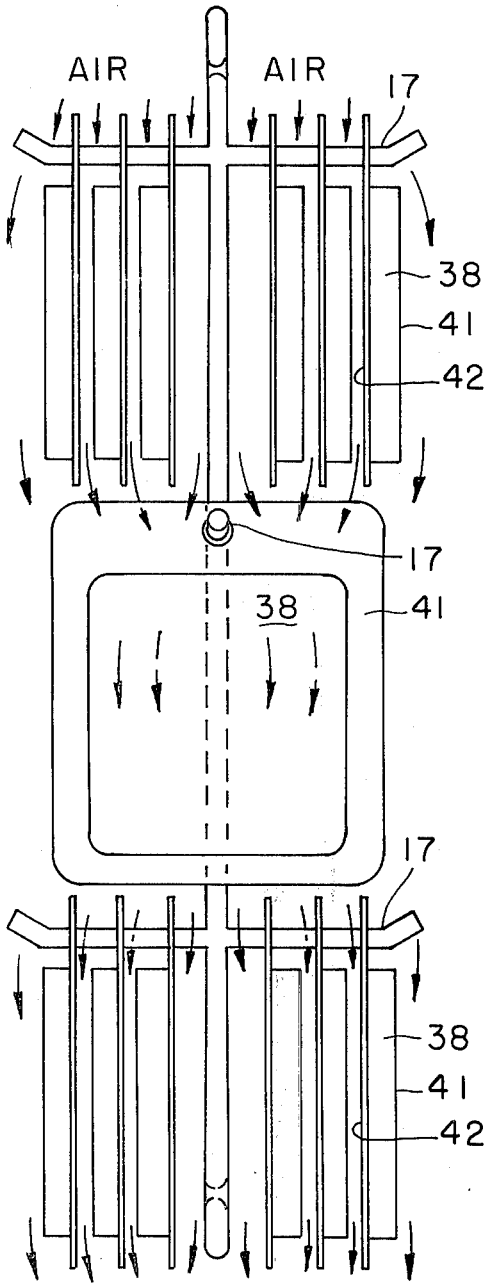
FIG. 5 is a side elevation view of the embodiment of FIG. 4.

Conditioning by means of a gaseous stream is more fully depicted in FIGS. 4 and 5. The front elevation view of FIG. 4 illustrates how conditioned air passes through the top row of articles 38 to be thereby directed along both sides 41, 42 of each article 38 in the next row down. By the same token, some of the conditioned air is then passed through such next row of articles 38 to be thereby directed along both sides of each article 38 in the bottom row. FIG. 5 illustrates this same air passage as viewed from the side. It will also be noted that in FIGS. 4 and 5, there is provided a single hanger member 11 which has three pairs of arms 17 protruding therefrom in alternate perpendicular planes.

Obviously, many modifications and variations of the invention as hereinbefore set forth may be made without departing from the spirit and scope thereof, and only such limitations should be imposed as are indicated in the appended claims.

We claim:

1. In a display case having a substantially vertical open front and a space with a conditioned environment; a means for supplying a flow of said conditioned environment along said substantially vertical open front; said open front having an upper portion and a lower portion; the improvement comprising: a hanger member suspended within said open front; said hanger member having a vertically disposed elongate body member; said body member having means for suspending same within said open front; said body member having a substantially horizontal arm projecting therefrom for hanging articles within said open front; and said hanger member, when articles are hanging thereon, being a distributor and receiver of said flow of conditioned environment along said substantially vertical open front from said upper portion of the front, between and along articles on said hanger member, and to said lower portion of the front.

2. The display case of claim 1, wherein a plurality of said arms project from said body member, each arm being positioned one above the other along said body member, each arm lying along a substantially vertical plane that is approximately perpendicular to the substantially vertical plane passing through the arm that is immediately above or below said each arm, and, when a plurality of articles are suspended on said arms, both sides of the articles are subjected to the conditioned environment, said conditioned environment passing between and along said articles suspended from one arm to those suspended from the other arm.

3. The display case of claim 1, further including a plurality of articles suspended on said arm, whereby both sides of the articles are subjected to the conditioned environment, said conditioned environment passing between and along the articles.

4. The display case of claim 1, wherein said means for supplying a conditioned environment comprises: a refrigeration means for supplying a stream of cooled air, a cooled air outlet in the top, inside wall of the open front of said case, said outlet being in communication with said refrigeration means, an air intake vent in the bottom, inside wall of the open front of said case, said intake vent being in communication with said refrigeration means; a plurality of said arms projecting substantially perpendicularly from said body member, each arm being positioned above another arm along said body member, and said one arm lying along a substantially vertical plane that is approximately perpendicular to a substantially vertical plane passing through said another arm; and a plurality of articles hanging on said arms, whereby both sides of the articles suspended from said arms are contacted with said stream of cooled air that passes down between and along said articles.

5. The apparatus of claim 1, further including a cap from which said hanger member is suspended.

6. The apparatus of claim 5, wherein said cap includes a louver through its horizontal face.

7. The apparatus of claim 1, further including a bottom block which is suspended from said hanger member.

8. The apparatus of claim 7, wherein said bottom block includes a louver through its horizontal face.

9. A method for conditioning articles, comprising: supplying a vertical space of conditioned environment in the access opening in the front wall of a display case, vertically suspending articles within said vertical space, positioning said articles in a plurality of rows, locating at least one of said rows such that the articles suspended in said one row lie along substantially vertical planes substantially within said vertical space, locating at least one other of said rows such that the articles suspended in said other rows lie along substantially vertical planes that are perpendicular to said planes along which lie said one row, passing a flow of the conditioned environment from an upper portion of said access opening, between, through and along said rows of articles, and to a lower portion of said access opening, subjecting each of said articles to said conditioned environment, and promoting the distribution and reception of said conditioned environment within said vertical space and within said display case by the directing action of said rows or articles.

10. The method of claim 9, wherein said conditioned environment is refrigerated air, and said directing step includes downwardly flowing a stream of cooled air from an upper, inside wall of the display case.

11. The method of claim 9, wherein said positioning of the articles includes locating the articles in an uppermost one of said rows along planes lying substantially parallel to said vertical space.

* * * * *

UNITED STATES PATENT OFFICE

CERTIFICATE OF CORRECTION

PATENT NO. : 3,999,821

DATED : December 28, 1976

INVENTOR(S) : CHARLES M. MOODY and FREDRICK L. PRIEBE

It is certified that error appears in the above-identified patent and that said Letters Patent are hereby corrected as shown below:

The patent should show on its face that it is assigned to Swift & Company of Chicago, Illinois.

Signed and Sealed this

*sixteenth* Day of *August 1977*

[SEAL]

*Attest:*

RUTH C. MASON
*Attesting Officer*

C. MARSHALL DANN
*Commissioner of Patents and Trademarks*